US011253433B2

(12) United States Patent
Davis et al.

(10) Patent No.: US 11,253,433 B2
(45) Date of Patent: Feb. 22, 2022

(54) BREAST FEEDING ASSEMBLY

(71) Applicants: Lisa Davis, Chicago, IL (US); Keyla Fouch, Chicago, IL (US)

(72) Inventors: Lisa Davis, Chicago, IL (US); Keyla Fouch, Chicago, IL (US)

( * ) Notice: Subject to any disclaimer, the term of this patent is extended or adjusted under 35 U.S.C. 154(b) by 174 days.

(21) Appl. No.: 16/660,296

(22) Filed: Oct. 22, 2019

(65) Prior Publication Data

US 2021/0113435 A1 Apr. 22, 2021

(51) Int. Cl.

*A47D 15/00* (2006.01)
*A61J 9/06* (2006.01)
*A61J 9/00* (2006.01)

(52) U.S. Cl.

CPC ..... *A61J 9/0676* (2015.05); *A61J 9/001* (2013.01); *A61J 9/0607* (2015.05)

(58) Field of Classification Search

CPC ..... A61J 9/0676; A61J 9/0607; A61J 9/001; A61J 9/06

See application file for complete search history.

(56) References Cited

U.S. PATENT DOCUMENTS 2,494,632 A 1/1950 Rodin
2,617,105 A * 11/1952 Backman ..... A41D 1/215 2/48
2,644,623 A * 7/1953 White ..... A61J 9/0676 224/148.5
2,760,664 A * 8/1956 Amico ..... A61J 9/00 215/11.1
2,924,413 A * 2/1960 Mahoney ..... A45F 5/00 224/148.5
3,117,874 A * 1/1964 Horan ..... A61J 9/008 426/117
3,144,230 A 8/1964 Brooks
3,977,638 A 8/1976 Woodard
4,090,650 A * 5/1978 Gotta ..... A45F 3/20 215/11.1
4,220,302 A * 9/1980 Hampton ..... A61J 9/0676 224/148.6
D264,993 S * 6/1982 Kestenberg ..... A45F 3/20 D24/198
4,537,341 A * 8/1985 Kelly ..... A61J 9/0638 224/620
4,640,425 A * 2/1987 Cabernoch ..... A61J 9/005 215/11.1
4,718,623 A 1/1988 McClure
4,776,546 A * 10/1988 Goldson ..... A61J 9/00 224/148.4

(Continued)

*Primary Examiner* — Amy J. Sterling

(57) ABSTRACT

A breast feeding assembly includes a reservoir that is fillable with a nourishing fluid. A nipple is removably attachable to the reservoir to be suckled by an infant thereby facilitating the infant to consume the nourishing fluid. A pouch is wearable on a user's chest and the reservoir is removably positionable in the pouch. The pouch has a nipple opening therein and the nipple extends outwardly through the nipple opening when the reservoir is positioned in the pouch. A first belt is coupled to the pouch and the first belt is extendable around the user's chest for retaining the pouch on the user's chest. A second belt is coupled to the pouch, the second belt is extendable around the user's chest for retaining the pouch on the user's chest and the second belt is matable to the first belt.

8 Claims, 4 Drawing Sheets

(56) References Cited

U.S. PATENT DOCUMENTS

| | | | | | |
|---|---|---|---|---|---|
| 5,086,517 | A * | 2/1992 | Jones | A61J 9/00 | 2/104 |
| 5,566,869 | A * | 10/1996 | Katz | A45F 3/16 | 137/516.11 |
| 5,582,335 | A * | 12/1996 | Beard | A61J 9/0661 | 215/11.6 |
| 5,906,298 | A * | 5/1999 | Ward | A61L 9/127 | 222/175 |
| 6,415,960 | B1 * | 7/2002 | Fink | B67D 3/00 | 222/175 |
| 6,669,064 | B2 * | 12/2003 | Perricone | A61J 9/001 | 215/11.3 |
| D526,776 | S | 8/2006 | Riley | | |
| 8,444,021 | B1 * | 5/2013 | Ferreiro | A45F 3/20 | 222/175 |
| 8,915,408 | B1 * | 12/2014 | Hill | A61J 9/0676 | 224/148.4 |
| 10,625,004 | B2 * | 4/2020 | Hill | A61M 1/06 | |
| 2005/0279784 | A1 * | 12/2005 | Swank | A45F 3/20 | 224/148.5 |
| 2008/0185408 | A1 * | 8/2008 | James | A45F 3/20 | 224/148.2 |
| 2009/0166481 | A1 * | 7/2009 | Chen | A61J 9/0638 | 248/102 |
| 2021/0085567 | A1 * | 3/2021 | Vaughn | A61J 9/005 | |

* cited by examiner

BREAST FEEDING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to feeding devices and more particularly pertains to a new feeding device for simulating breast feeding an infant.

(2) Description of Related Art Including Information Disclosed Under 37 CFR 1.97 and 1.98

The prior art relates to feeding devices.

BRIEF SUMMARY OF THE INVENTION

An embodiment of the disclosure meets the needs presented above by generally comprising a reservoir that is fillable with a nourishing fluid. A nipple is removably attachable to the reservoir to be suckled by an infant thereby facilitating the infant to consume the nourishing fluid. A pouch is wearable on a user's chest and the reservoir is removably positionable in the pouch. The pouch has a nipple opening therein and the nipple extends outwardly through the nipple opening when the reservoir is positioned in the pouch. A first belt is coupled to the pouch and the first belt is extendable around the user's chest for retaining the pouch on the user's chest. A second belt is coupled to the pouch, the second belt is extendable around the user's chest for retaining the pouch on the user's chest and the second belt is matable to the first belt.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
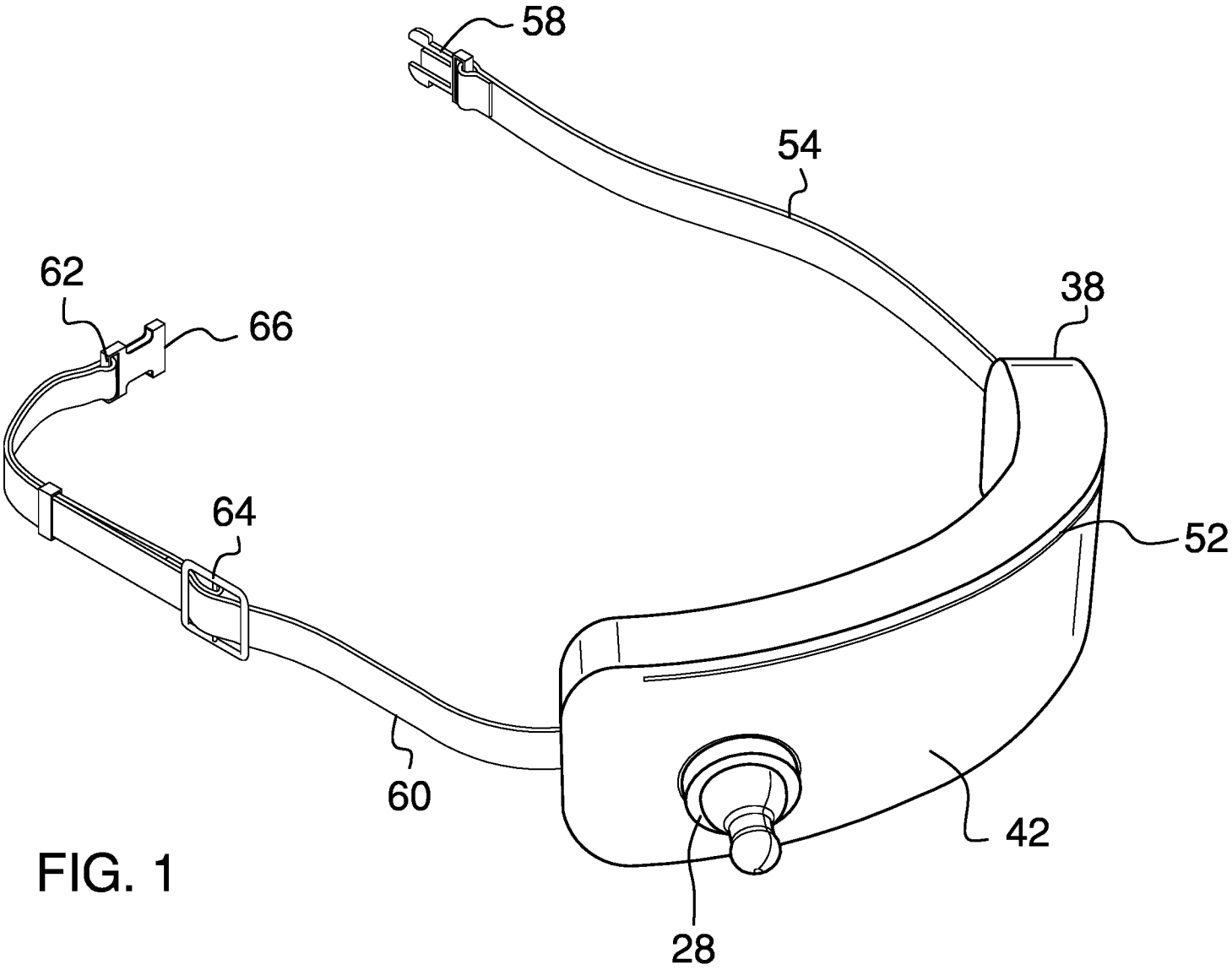
FIG. 1 is a front perspective view of a breast feeding assembly according to an embodiment of the disclosure.
Figure 2:
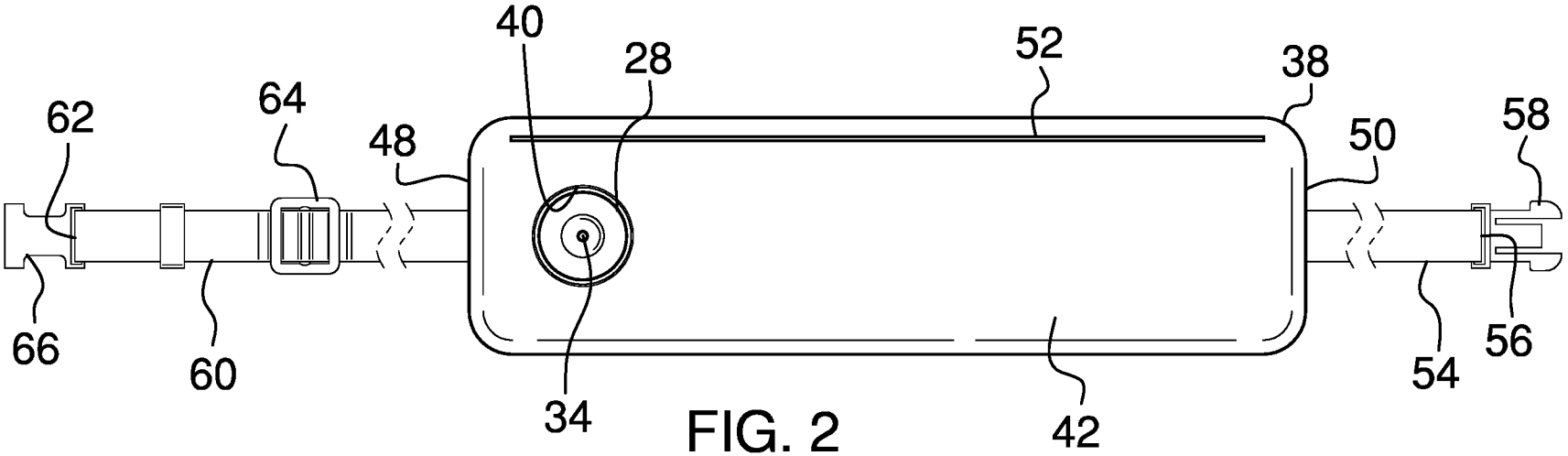
FIG. 2 is a front view of an embodiment of the disclosure.
Figure 3:
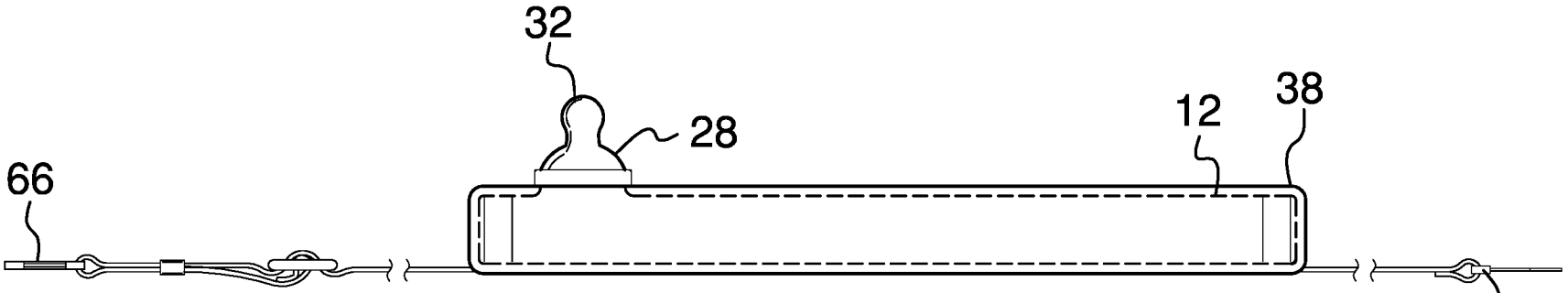
FIG. 3 is a top phantom view of an embodiment of the disclosure.
Figure 4:
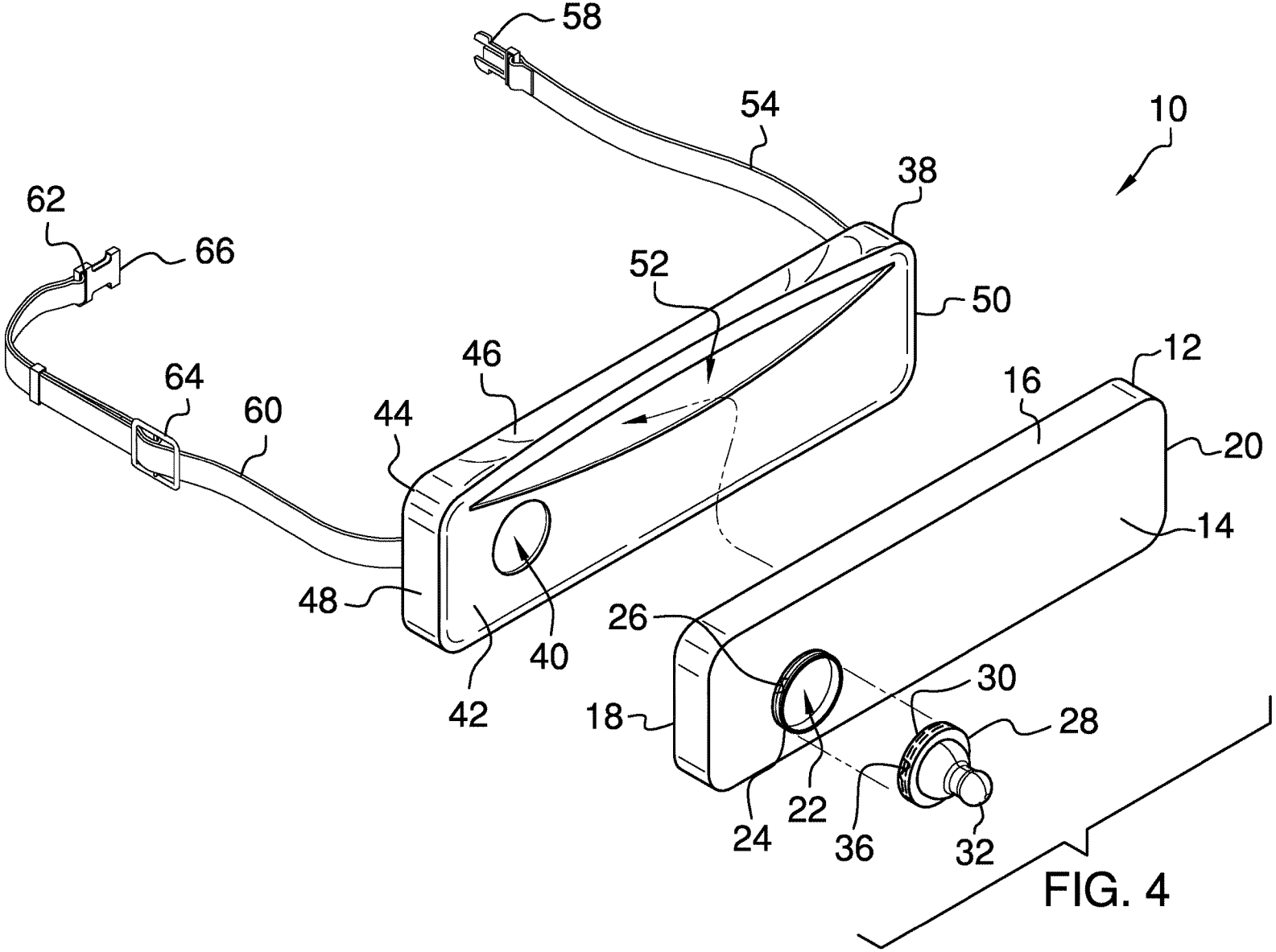
FIG. 4 is an exploded perspective view of an embodiment of the disclosure.
Figure 5:
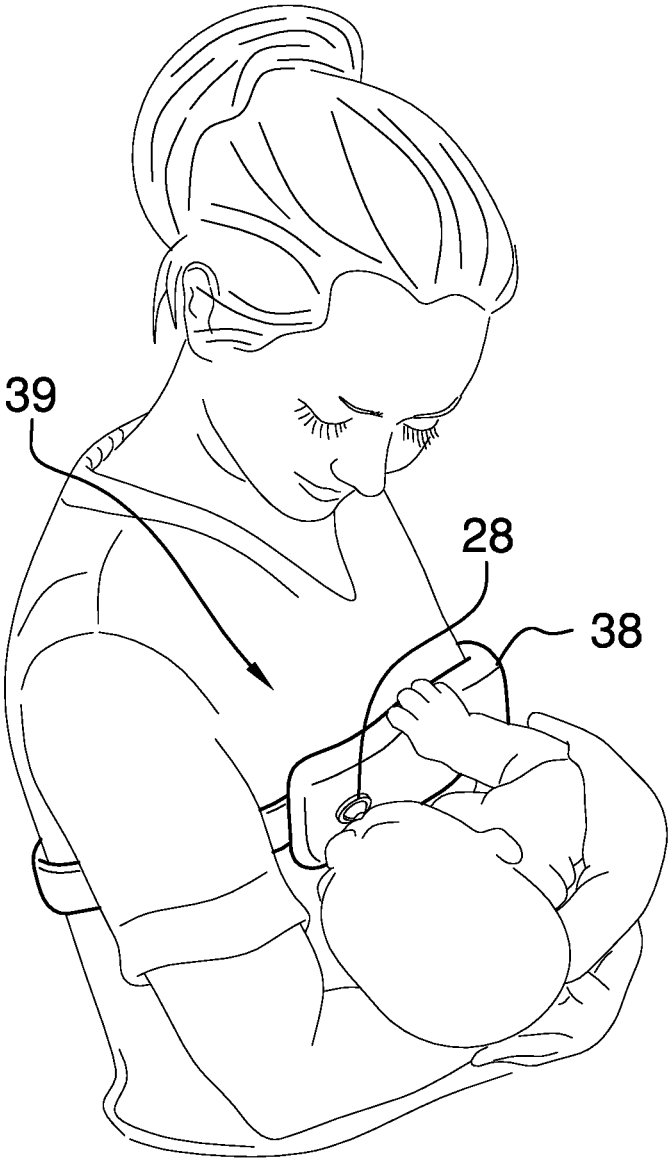
FIG. 5 is a perspective in-use view of an embodiment of the disclosure.

With reference now to the drawings, and in particular to FIGS. 1 through 5 thereof, a new feeding device embodying the principles and concepts of an embodiment of the disclosure and generally designated by the reference numeral 10 will be described.

As best illustrated in FIGS. 1 through 5, the breast feeding assembly 10 generally comprises a reservoir 12 that is fillable with a nourishing fluid. The nourishing fluid may be infant formula, milk or any other fluid for feeding an infant. The reservoir 12 is comprised of a fluid impermeable material. The reservoir 12 has a front wall 14 and a perimeter wall 16, and the perimeter wall 16 has a first lateral side 18 and a second lateral side 20. Additionally, the reservoir 12 is elongated between the first lateral side 18 and the second lateral side 20.

The front wall 14 has an aperture 22 extending into an interior of the reservoir 12. The front wall 14 has a lip 24 extending forwardly therefrom and the lip 24 surrounds the aperture 22. The lip 24 has an outwardly facing surface 26 and the outwardly facing surface 26 is threaded. Additionally, the aperture 22 is positioned closer to the first lateral side 18 than the second lateral side 20.

A nipple 28 is removably attachable to the reservoir 12 and the nipple 28 can be suckled by an infant thereby facilitating the infant to consume the nourishing fluid. The nipple 28 may be comprised of a deformable material similar to that of a baby feeding nipple 28. The nipple 28 has a back end 30 and a forward end 32, the back end 30 is open, the forward end 32 has a dispensing hole 34 extending therethrough and the forward end 32 is rounded. The nipple 28 has an inside surface 36 and the inside surface 36 is threaded adjacent to the back end 30. The inside surface 36 threadably engages the outwardly facing surface 26 of the lip 24 to removably attach the nipple 28 to the reservoir 12. In this way the nipple 28 receives the nourishing fluid.

A pouch 38 is provided and the pouch 38 is wearable on a user's chest 39. The reservoir 12 is removably positionable in the pouch 38. The pouch 38 has a nipple opening 40 therein and the nipple 28 extends outwardly through the nipple opening 40 when the reservoir 12 is positioned in the pouch 38. The pouch 38 has a forward wall 42, a rear wall 44 and an outer wall 46 extending therebetween. The outer wall 46 has a first lateral side 48 and a second lateral side 50, and the pouch 38 is elongated between the first lateral side 48 and the second lateral side 50 of the outer wall 46.

The forward wall 42 has a cut 52 extending into an interior of the pouch 38. The cut 52 extends substantially between the first lateral side 48 and the second lateral side 50 of the outer wall 46. The reservoir 12 is insertable through the cut 52. The nipple opening 40 extends through the forward wall 42 into the interior of the pouch 38. The nipple opening 40 is positioned below the cut 52 and the nipple opening 40 is positioned closer to the first lateral side 48 of the outer wall 46 than the second lateral side 50 of the outer wall 46. The nipple 28 extends through the nipple opening 40 when the reservoir 12 is positioned in the pouch 38. In this way the nipple 28 can be positioned on the user's chest 39 in a similar position to a respective one of the user's nipples.

A first belt 54 is coupled to the pouch 38 and the first belt 54 is extendable around the user's chest 39 for retaining the pouch 38 on the user's chest 39. The first belt 54 extends away from the rear wall 44 of the pouch 38 and the first belt 54 extends laterally away from the first lateral side 48 of the outer wall 46 of the pouch 38. The first belt 54 has a distal end 56 with respect to the pouch 38. A first mating member 58 is coupled to the distal end 56 of the first belt 54 and the first mating member 58 may comprise a female buckle or other type of releasable fastener.

A second belt 60 is coupled to the pouch 38 and the second belt 60 is extendable around the user's chest 39 for retaining the pouch 38 on the user's chest 39. The second belt 60 extends away from the rear wall 44 of the pouch 38 and the second belt 60 extends laterally away from the second lateral side 50 of the outer wall 46 of the pouch 38. The second belt 60 has a distal end 62 with respect to the pouch 38. An adjuster 64 is provided and the second belt 60 is looped therethrough for adjusting a length of the second belt 60. A second mating member 66 is coupled to the distal end 62 of the second belt 60 and the second mating member 66 releasably engages the first mating member 58 for retaining the pouch 38 on the user's chest 39. The second mating member 66 may comprise a male buckle or other type of releasable fastener.

In use, the reservoir 12 is filled with the nourishing fluid and the nipple 28 is attached to the reservoir 12. The reservoir 12 is inserted into the pouch 38 having the nipple 28 extending outwardly through the nipple opening 40 in the pouch 38. The first belt 54 and the second belt 60 are wrapped around the user's chest 39 to position the pouch 38 on the user's chest 39. In this way the nipple 28 facilitates the infant to feed from the nourishing fluid in a manner that simulates breast feeding.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A breast feeding assembly being configured to facilitate a non-breastfeeding caregiver to simulate breastfeeding for an infant, said assembly comprising:

a reservoir being tillable with a nourishing fluid, said reservoir being comprised of a fluid impermeable material;

a nipple being removably attachable to said reservoir wherein said nipple is configured to be suckled by an infant thereby facilitating the infant to consume the nourishing fluid;

a pouch being wearable on a user's chest, said reservoir being removably positionable in said pouch, said pouch having a nipple opening therein, said nipple extending outwardly through said nipple opening when said reservoir is positioned in said pouch;

a first belt being coupled to said pouch, said first belt being extendable around the user's chest for retaining said pouch on the user's chest; and a second belt being coupled to said pouch, said second belt being extendable around the user's chest for retaining said pouch on the user's chest, said second belt being matable to said first belt;

said reservoir having a front wall and a perimeter wall, said perimeter wall having a first lateral side and a second lateral side, said reservoir being elongated between said first lateral side and said second lateral side;

said front wall having an aperture extending into an interior of said reservoir, said aperture being positioned closer to said first lateral side than said second lateral side;

said front wall having a lip extending forwardly therefrom, said lip surrounding said aperture, said lip having an outwardly facing surface, said outwardly facing surface being threaded; and said pouch having a forward wall, a rear wall and an outer wall extending therebetween, said outer wall having a first lateral side and a second lateral side, said pouch being elongated between said first lateral side and said second lateral side of said outer wall, said forward wall having a cut extending into an interior of said pouch, said cut extending substantially between said first lateral side and said second lateral side of said outer wall, said reservoir being insertable through said cut; and said nipple opening extending through said forward wall into said interior of said pouch, said nipple opening being positioned below said cut, said nipple opening being positioned closer to said first lateral side of said outer wall than said second lateral side of said outer wall, said nipple extending through said nipple opening when said reservoir is positioned in said pouch wherein said pouch is configured to be positioned extending across the user's chest with said nipple being in a position over a selectable one of the user's nipples.

2. The assembly according to claim 1, wherein said nipple has a back end and a forward end, said back end being open, said forward end having a dispensing hole extending therethrough, said forward end being rounded, said nipple having an inside surface, said inside surface being threaded adjacent to said back end, said inside surface threadably engaging said outwardly facing surface of said lip to removably attach said nipple to said reservoir wherein said nipple is configured to receive the nourishing fluid.

3. The assembly according to claim 1, wherein said first belt extends away from said rear wall of said pouch, said first belt extending laterally away from said first lateral side of said outer wall of said pouch, said first belt having a distal end with respect to said pouch.

4. The assembly according to claim 3, further comprising a first mating member being coupled to said distal end of said first belt.

5. The assembly according to claim 4, Wherein said second belt extends away from said rear wall of said pouch, said second belt extending laterally away from said second lateral side of said outer wall of said pouch, said second belt having a distal end with respect to said pouch.

6. The assembly according to claim 5, further comprising an adjuster having said second belt being looped therethrough for adjusting a length of said second belt.

7. The assembly according to claim 6, further comprising a second mating member being coupled to said distal end of said second belt, said second mating member releasably engaging said first mating member for retaining said pouch on the user's chest.

8. A breast feeding assembly being configured to facilitate a non-breastfeeding caregiver to simulate breastfeeding for an infant, said assembly comprising:

a reservoir being finable with a nourishing fluid, said reservoir being comprised of a fluid impermeable material, said reservoir having a front wall and a perimeter wall, said perimeter wall having a first lateral side and a second lateral side, said reservoir being elongated between said first lateral side and said second lateral side, said front wall having an aperture extending into an interior of said reservoir, said front wall having a lip extending forwardly therefrom, said lip surrounding said aperture, said lip having an outwardly facing surface, said outwardly facing surface being threaded, said aperture being positioned closer to said first lateral side than said second lateral side;

a nipple being removably attachable to said reservoir wherein said nipple is configured to be suckled by an infant thereby facilitating the infant to consume the nourishing fluid, said nipple having a back end and a forward end, said back end being open, said forward end having a dispensing hole extending therethrough, said forward end being rounded, said nipple having an inside surface, said inside surface being threaded adjacent to said back end, said inside surface threadably engaging said outwardly facing surface of said lip to removably attach said nipple to said reservoir wherein said nipple is configured to receive the nourishing fluid;

a pouch being wearable on a user's chest, said reservoir being removably positionable in said pouch, said pouch having a nipple opening therein, said nipple extending outwardly through said nipple opening when said reservoir is positioned in said pouch, said pouch having a forward wall, a rear wall and an outer wall extending therebetween, said outer wall having a first lateral side and a second lateral side, said pouch being elongated between said first lateral side and said second lateral side of said outer wall, said forward wall having a cut extending into an interior of said pouch, said cut extending substantially between said first lateral side and said second lateral side of said outer wall, said reservoir being insertable through said cut, said nipple opening extending through said forward wall into said interior of said pouch, said nipple opening being positioned below said cut, said nipple opening being positioned closer to said first lateral side of said outer wall than said second lateral side of said outer wall, said nipple extending through said nipple opening when said reservoir is positioned in said pouch wherein said pouch is configured to be positioned extending across the user's chest with said nipple being in a position over a selectable one of the user's nipples;

a first belt being coupled to said pouch, said first belt being extendable around the user's chest for retaining said pouch on the user's chest; said first belt extending away from said rear wall of said pouch, said first belt extending laterally away from said first lateral side of said outer wall of said pouch, said first belt having a distal end with respect to said pouch;

a first mating member being coupled to said distal end of said first belt;

a second belt being coupled to said pouch, said second belt being extendable around the user's chest for retaining said pouch on the user's chest, said second belt extending away from said rear wall of said pouch, said second belt extending laterally away from said second lateral side of said outer wall of said pouch, said second belt having a distal end with respect to said pouch;

an adjuster having said second belt being looped therethrough for adjusting a length of said second belt; and a second mating member being coupled to said distal end of said second belt, said second mating member releasably engaging said first mating member for retaining said pouch on the user's chest.

* * * * *